US005482284A

United States Patent [19]

Vandever

[11] Patent Number: 5,482,284

[45] Date of Patent: Jan. 9, 1996

[54] GOLF ADDRESS AND STANCE TEACHING AND PRACTICE DEVICE

[76] Inventor: Claude S. Vandever, P.O. Box 285, Nazareth, Pa. 18064

[21] Appl. No.: 104,172

[22] Filed: Aug. 9, 1993

[51] Int. Cl.[6] ..... A63B 69/36

[52] U.S. Cl. ..... 273/187 R; 33/508

[58] Field of Search ..... 273/187 R, 35 R, 273/187 A, 187.6, 191 R; 33/456, 495–500, 508

[56] References Cited

U.S. PATENT DOCUMENTS

| | | | |
|---|---|---|---|
| 1,208,995 | 12/1916 | Lyon . | |
| 1,517,555 | 12/1924 | Graham . | |
| 1,661,096 | 2/1928 | Rowe | 33/456 |
| 1,922,130 | 8/1933 | Haserodt . | |
| 2,025,519 | 12/1935 | Lingg . | |
| 2,150,580 | 3/1939 | Crowley . | |
| 2,364,149 | 12/1944 | Kent | 33/456 |
| 2,465,481 | 3/1949 | Reiche | 33/456 |
| 2,777,697 | 1/1957 | Crossot . | |
| 2,790,642 | 4/1957 | Rolfe . | |
| 2,886,326 | 5/1959 | Olds . | |
| 3,041,075 | 6/1962 | Taylor . | |
| 3,141,675 | 7/1964 | Street . | |
| 3,343,268 | 9/1967 | Schennum . | |
| 3,384,377 | 5/1968 | Stipp . | |
| 3,658,344 | 4/1972 | Kimble . | |
| 3,679,206 | 7/1972 | Shambaugh . | |
| 4,257,608 | 3/1981 | Funk . | |
| 4,354,683 | 10/1982 | Woolland . | |
| 4,434,983 | 3/1984 | Taggart . | |
| 4,538,815 | 9/1985 | Poirier . | |
| 4,544,161 | 10/1985 | Guendling . | |
| 5,014,994 | 5/1991 | Peters . | |

FOREIGN PATENT DOCUMENTS

| | | | |
|---|---|---|---|
| 327994 | 2/1919 | Germany | 33/456 |
| 1381598 | 1/1975 | United Kingdom | 273/187 R |

*Primary Examiner*—Mark S. Graham
*Attorney, Agent, or Firm*—Charles A. Wilkinson

[57] ABSTRACT

A golf training and practice apparatus is constructed with two major parts. The first part is a central hub from which four pointers extend in the direction in which the. golf ball is intended to be struck, towards the golf ball itself to indicate where it should lie, toward the feet of the golfer to indicate where such feet should be placed and a fourth tail of the target pointer which provides a longer path for aiding the visualization by the golfer of the intended path of the ball as well as an additional guide for one foot. The second major portion of the invention is a club face aligner which is attached to the ball pointer and allows the club face to be arranged at discreet angles matching the angles of the club face aligner just prior to swinging the club back and bringing it down into contact with the ball. The arrangement of the apparatus not only enables the inventor to readily visualize the positions he must take in addressing and striking the ball, but also the relationship of these positions in attaining a correct flight of the ball and also enables the golfer to determine beforehand the exact position of the club face at the moment of contact with the ball so that the flight of the ball may be more accurately determined.

9 Claims, 7 Drawing Sheets

FIG. 1
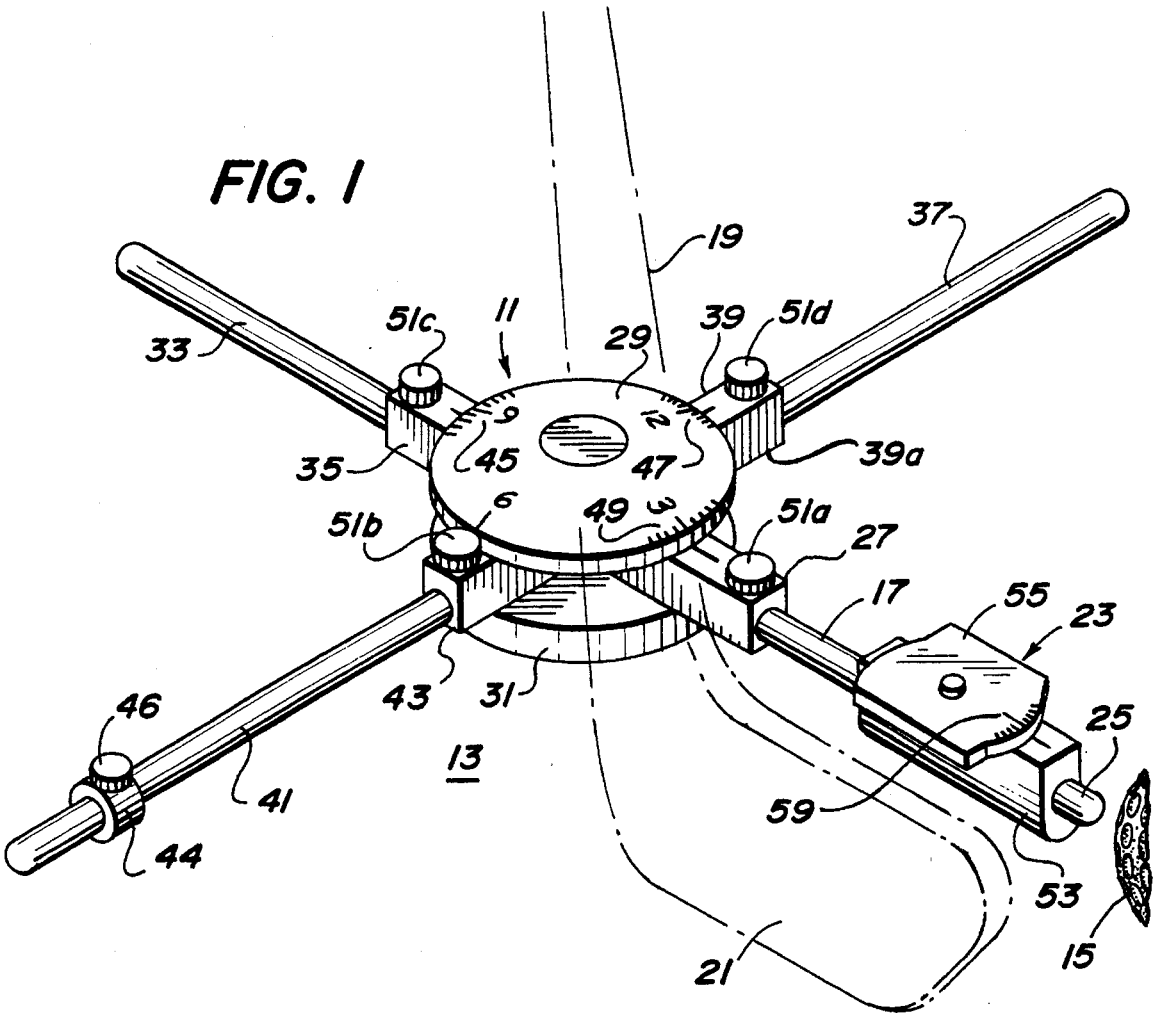
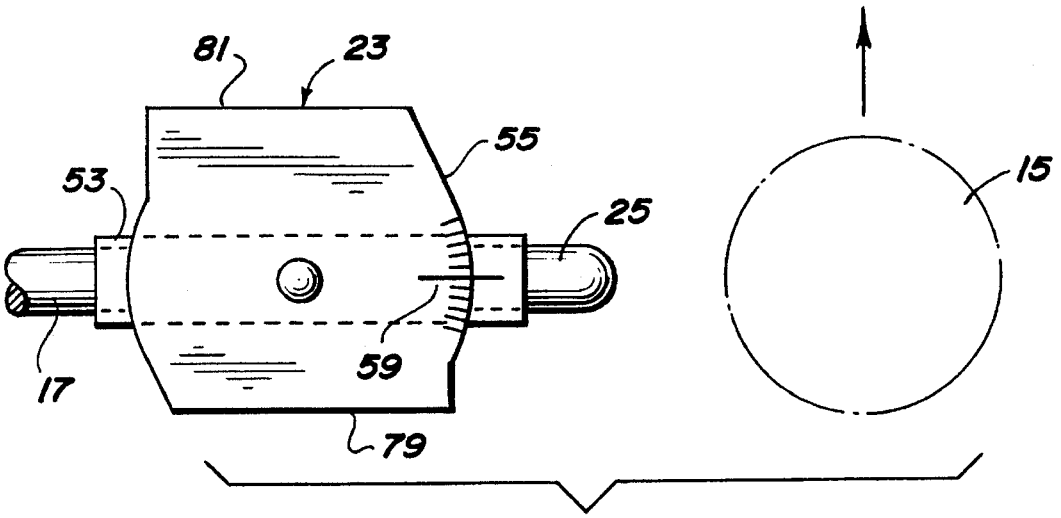
FIG. 5

FIG. 12
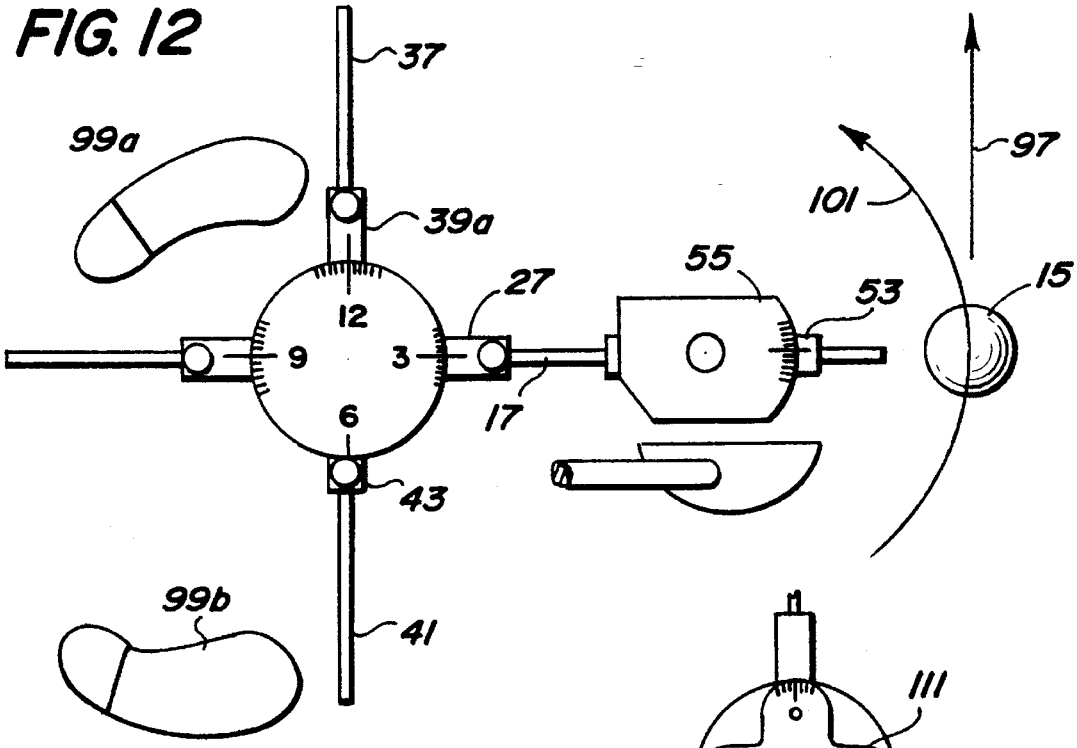
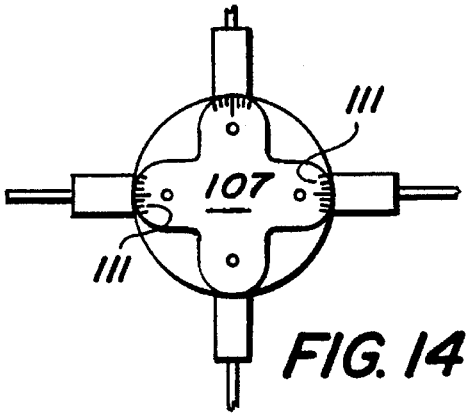
FIG. 14
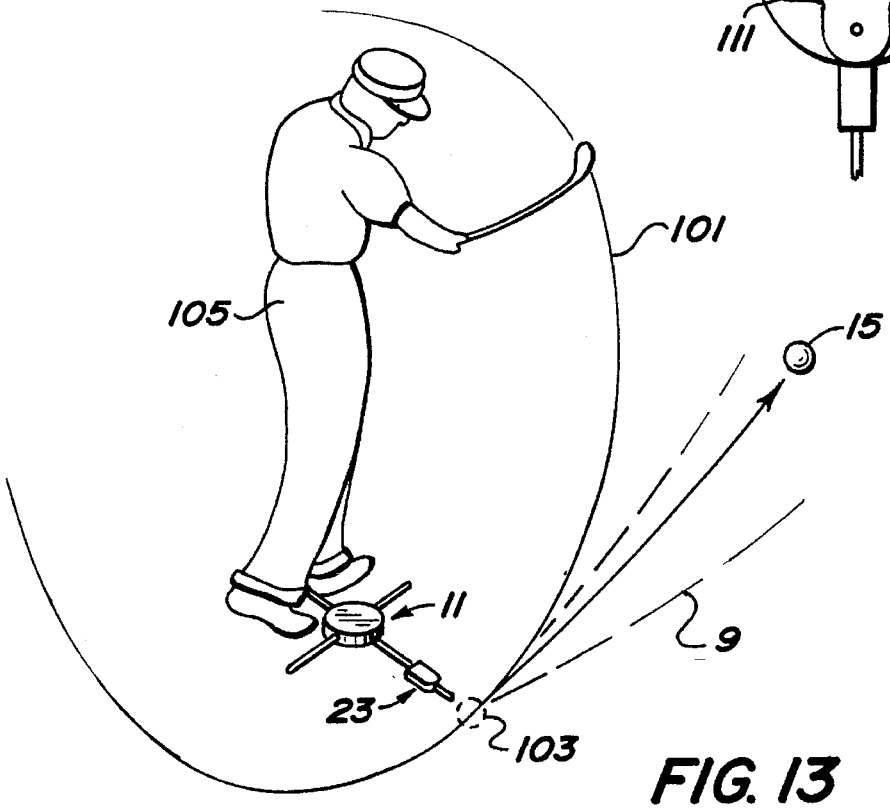
FIG. 13

GOLF ADDRESS AND STANCE TEACHING AND PRACTICE DEVICE

BACKGROUND OF THE INVENTION (1) Field of the Invention

This invention relates generally to golf practice and instruction aids and more particularly to an alignment indicator to be placed on the ground between a ball and a golfer for aiding such golfer, whether a beginner or an experienced golfer, to align and swing the golf club properly against the ball.

(2) Description of the Prior Art

The popular game of golf, which can be enjoyably played by both young and old, beginners and experts, with or without companions, is one of the most popular games in the United States as well as many foreign countries such as, for example, Scotland, Japan and other developed nations. As would be expected, much has been written concerning the proper playing of golf and various golf training devices have been developed and used as training aids. One of the simplest of these has been the practice of golf instructors for many years of laying one or two golf clubs on the ground extending between the golfers legs and toward the ball as well as pointing in the direction in which the ball is desired to go and along which the golf swing is to hopefully be made. These basic pointers have been found to aid the beginning golfer as well as some experts to better visualize what they are doing and/or at least, desire to do.

Basically, the theory of addressing a golf ball and striking it with a club is fairly simple. If one strikes the ball squarely with the club face aligned exactly in the direction the ball is to go and the swing is oriented in the same direction, the ball will, in fact, be propelled in that direction. On the other hand, if the club face is angled slightly to the left, i.e. closed or angled forwardly, or to the right, i.e. open or angled back, as it strikes the balland the swing is forward, known as the direct swing path, the ball will be deflected slightly either to the left or the right, depending upon the amount of angle the club face assumes. Furthermore, the ball will be given a spin as it travels through the air, and such spin will cause it to curve even farther in the same direction, the spin quickly, assuming a major factor in the actual direction of the flight of the ball.

If the angle of the club face is to the left for a right-handed golfer, the trajectory of the ball will "hook" to the left, while if the club face has a right-hand angle, the ball will slice to the right. The ball will be provided with more or less rotation as it is propelled into the air, the amount of spin depending upon the degree of angle of the club face and the strength of the golf swing. Such spin of the ball in the air, by altering the passage of air over the ball surface, causes the ball to curve in the direction toward which it originally deviated and, given a long enough flight, such ball may actually land relatively far to the side of the target (the hole) or from the direction toward which it first began its flight. In order to counteract the effect of the side spin of the ball and have a rapidly spinning ball still land near the target, the club swing can be deviated into a slight in-and-out or out-and-in swing line or path rather than a direct swing path. In other words, if a golfer should wish to have the ball follow a more or less arcuate path around an obstacle on the course, the golfer may swing the club more from the inside out with a closed or forwardly inclined club face causing the ball to first travel to the right of the target and then curve back toward the target. On the other hand, if the golfer wishes to counteract a cross wind, he or she may adopt a direct swing path, rather than a side deviated swing path, but with the side spin of the ball curving it to counteract the cross wind.

The spin on the golf ball is exactly analogous to the spin applied to a baseball by a pitcher to throw a curved ball, or to a Ping-Pong ball to cause similar curved flight (known as top spin or smash) or to some extent in bowling where a side spin of the ball interacts with the surface of the lane rather than with the air to cause a curved path of the ball, a bowling ball having in any event too much mass to allow differential air flow over the surface to have much, if any, effect upon the trajectory of the ball.

There are two other flights of the ball referred to as a "push" and a "pull" where the face of the club is turned somewhat to the left or the right of the nominal target, but the swing of the club is closer to the direct swing path and not as much angle is applied to the club face so that the ball is, in effect, hit straight on even though the golfer's stance is addressed essentially toward the nominal target. While expert golfers may use this technique sometimes to attain a particular trajectory because of the lay of the course or other reasons, the term is used more frequently to describe what has actually happened unintentionally than what is desired to happen, because in normal circumstances, the golfer will be better off arranging his stance at least on a fairly level portion of the course so that he or she is directly aligned or addressed to the ball with respect to the target.

Two further terms that are frequently applied to golf strokes or shots are "fade" and "draw". A "fade" is nothing more than a slice which, either because the spin on the ball is fairly slight or because the ball flight was not sufficiently long, begins its flight first to the left (for a right-handed golfer,) but then curved slightly to the right so its impact is to the left of the nominal target, but still more to the right than its original trajectory would have indicated or predicted. Similarly, a "draw" is little more than a weak hook which did not take the ball to the left of the target, but to the right, even though its final impact is not as far to the right as its original trajectory or initial flight path would have predicted.

So far as controlling the deviation of the ball toward the target area is concerned, therefore, there are really only three basic ways to hit the ball: (a) straight, with the golf head squarely aligned with the direction the ball is desired to travel, or rotated somewhat either, (b) left or closed, for a hook or a draw, or (c) right or open, for either a slice or a fade. Pushes or pulls can be substituted for, in most cases, by a change of direction of the entire golf stance, rather than changing the swing angle. While the theory of what to do to obtain accurate golf ball flight is, therefore, relatively simple, the implementation and particularly the reproducibility of golf ball flight is not.

Another factor which complicates the foregoing relatively simple relationships is the so-called "loft" of the club, which applies lift to the ball. The loft of the club is the upward angle of the club face which determines largely the upward component of motion of the ball when it is hit. Again, the club face tends to give spin to the ball, in this case backspin, which, in this case, causes it to turn or curve toward the ground decreasing its flight. Consequently, the flight of a lofted ball is relatively short and used basically for lifting over barriers or impediments. An upward curve cannot be provided to a ball because of the overpowering influence of gravity continuously urging the ball downwardly and also because a spin appropriate to lifting the ball would require a downwardly inclined club face causing the ball initially to be struck toward the ground causing it to bounce rather than curve.

The inclination of a golf club blade to the left or the right at the moment of striking the ball is relatively difficult to control. This is because, unlike, for example, a baseball bat in which the main striking surface of the bat is directly in the center of the bat and where, although the flight of the ball can be controlled somewhat by hitting or striking the ball either below or above the mid-line of the bat, or before or after it passes the mid-line of the bat's swing, the difficulty of hitting the ball at all, since it is a moving target which the pitcher is trying to prevent from being hit at all, the ability to hit the ball at all overshadows the accuracy of striking the ball. However, in the case of a golf club, the golf striking blade extends from the side of the club so it presents a restricted striking surface off center from the shaft of the club itself. Thus, while a golf ball is a stationary target with which the club can be aligned beforehand rather than a moving target as in, for example, baseball, golfers, like baseball players, are frequently just happy to hit the ball whatever way it goes, at least within reason.

Nevertheless, as can be seen from the above explanation, it is very important to hit a golf ball with a carefully aligned golf blade or golf club head, if an accurate trajectory is to be obtained, since arriving eventually at a very restricted portion of the golf course is the sine qua non of playing golf, at least competitively with other golfers. The angle of the golf head or blade must, therefore, be very accurately aligned and swung, which is far from easy to do, particularly since the angle of the blade will vary throughout the swing and the angle of the swing is inherently, because the swing must be at an angle to the earth, out of line with the intended line of flight of the ball. There is only one intersecting or tangent point, therefore, between the travel of the golf club head and the intended flight of the ball as well as the target line, which usually is not the same.

Correctly striking a golf ball, compared to striking other game balls, may be analogized somewhat to the difference between driving a car and flying an airplane. In the case of a car, one can see and feel the road and normally immediately observe the effect between the car and the road of movements of the steering wheel, applying the brakes and the like. In an airplane, however, one can get into a lot of difficulty by merely trying to observe what is happening. Rather, the really good pilot can visualize in his mind what is happening as the invisible air passes over the wing and control surfaces of the plane, so that he can better anticipate the effect of changes which he applies to the control surface.

Likewise in golf, many of the relationships of the ball to the club are not readily apparent when preparing to strike the ball and the really successful golfer should desirably be able to visualize the relationship between the ball and the movement of the club as well as the striking surface of the club rather than just following previously learned kinesthetic cues learned by extended practice, particularly since golf is essentially a game of flight strategy of a ball.

Not only is it difficult to attain a correct and efficient golf swing and stance initially, but it is difficult to duplicate any swing. There have been a veritable plethora of golf aids to aid or help the golfer not only to strike the ball originally, but also to aid the golfer during practice to set himself or herself in a position for successful swings. Examples of such devices are those which attempt to merely aid the golfer in aligning his swing with the ball by the use of visual references and indicators indicating where he is to address the ball, i.e. basically place his or her feet, and where the ball is to be aimed, basically giving the golfer something to aim at and those which actually attempt to place the golfer in a correct stance by physically guiding or impinging upon the body itself. Examples of the latter type of aid are the U.S. Pat. No. 2,690,911 issued Oct. 5, 1954 to A. E. Newgren comprising a framework which actually aligns or guides the golfer's body stance and to a lesser extent, the inventions of U.S. Pat. No. 3,197,209 issued Jul. 27, 1965 to J. C. Arena, which provides a single upwardly extending arm guide and U.S. Pat. No. 4,298,201, issued Nov. 3, 1981 to B. Palinkas, which provides a sighting device to be clipped to a golfer's hat.

A second type of alignment device or aid is the type which is merely placed on the ground in front of a golfer and aids such golfer in placement of his or her feet and/or visualizing the way the ball is to go. Examples of this type of device are provided by U.S. Pat. No. 2,606,026 issued Aug. 5, 1952 to B. F. Young, U.S. Pat. No. 3,166,327 issued Jan. 19, 1965 to R. S. Champion and U.S. Pat. No. 3,718,330 issued Feb. 17, 1973 to V. T. Gorite which basically provide ground supported devices against or close to which the golfer places his or her feet and aims, usually in the direction of an arrow. A further patent is U.S. Pat. No. 3,429,577 issued Feb. 25, 1969 to K. B. Godden et al. for a golf practice device providing several artificially pivoted balls to be impinged upon during the golf swing to aid in aligning such swing.

The present Applicant's device is a very much improved version of the type of aid in which the stance and target direction are indicated and in which adjustments can moreover be made to accommodate to the particular golfer as well as the particular problem. In addition, Applicant's device naturally aids the golfer in visualizing the desired relationship of his club to the ball and also provides a universally adjustable guide which allows easy and practical monitoring and duplication of previous successful golf swings. Prior art references of particular pertinence are described below.

In general, the prior art pertaining particularly to devices or aids to aligning the feet of a golfer and the ball, plus pointing the way the ball is supposed to travel, have involved the use of one or more pointers which are laid or otherwise placed upon the ground in front of the golfer or between the feet of the golfer to aid in aligning the golfer with the ball prior to striking such ball. Particular prior art of this nature includes the following:

U.S. Pat. No. 1,208,995 issued Dec. 19, 1916 to W. A. Lyon discloses an early golf teaching instrument not too far advanced over the use of two crossed golf clubs on the ground. The device consists of two pivoted-together rods plus a cross rod or pointer arranged transversely of the two pivoted rods. The pointer is formed from a bar which slides over the top of the two rods to one of which it is also pivoted. The cross bar is pointed at one end and is intended to delineate the direction in which the ball is hoped to travel. The two rods include telescopically sliding extensions on their ends which serve to, in effect, extend the ends of the rods so that they almost contact the front of the golfer's feet to delineate a proper golf stance. The device folds up so it may be easily placed in a golf bag or caddy bag. In use, the golf teaching instrument of Lyon is placed on the ground in front of the golfer with the apex of the two pivoted rods near the golf ball and the ends of the two pivoted together rods aligned in front of the two feet of the golfer. The cross bar or pointer is then adjusted to point in the direction the ball is to take. The device includes an arcuate sliding member with a set screw to set the position of the pointer so that once the correct ball address stance is found, it can be again duplicated. The arcuate adjustment of the arrow pointer plus the lengthening adjustment of the arms are substantially the only adjustments possible, although it is indicated the instrument can be adjusted to provide a stance for driving hooks and slices.

U.S. Pat. No. 1,517,555 issued Dec. 2, 1924 to L. V. Graham discloses a stance indicator for use in golf. The stance indicator comprises a series of basically yardsticks members arranged both at right angles and parallel to each other. Side members, which are arranged transversely to the main indicating member, are arranged so that the two of them may be slid longitudinally of such main member and the third may be slid transversely of such main member along the end. When the device is used, the golfer will position his or her feet as well as the golf ball at various positions along the device according to the index numbers provided on the members based either upon experience or instructions associated with the device. It is indicated that for training, the golferwill place his or her feet at predetermined points, while during practice, the golfer may mark where he or she has his feet placed on the ground and then by placing the apparatus of the invention at such position, determine what the spacing was in actuality. There is no target alignment indicator on the Graham device.

U.S. Pat. No. 1,922,130 issued Aug. 15, 1933 to O. P. Haserodt discloses a so-called golfer's stance appliance which is said to be simplified, a description which appears fairly apt, since the device is merely two bars having number indications along the sides, one of which bars slides transversely with respect to the other. The transversely slideable bar is apparently placed against or adjacent to the ball and the feet of the golfer, depending on experience or instructions. The feet of the golfer are then placed at various points along the main indicator identified by the continuous numbers along such indicator. The device is formed of rubber, leather or canvas and may be folded into a compact package and carried in a pocket when not in use. The principal advantage of the device appears to be its general physical flexibility allowing it to be folded up for storage and transportation.

U.S. Pat. No. 2,025,519 issued Dec. 24, 1935 to T. L. Lingg discloses a further golfer's stance gage formed from flexible steel strip basically like a steel measuring tape or the like. Several sections of the steel tape are pivoted together and there are various index figures along the sides so that various positions can be reproduced with respect to stance and addressing the ball. The device can be used by either left-handed or right-handed golfers by merely turning such device over. The device can be rolled up into a carrying case apparently somewhat in the same manner as a steel rule. The shape is somewhat like the earlier Lyon device except that the folded end is arranged to point at the target while a perpendicular section extends toward the ball.

U.S. Pat. No. 2,150,580 issued Mar. 14, 1939 to R. Crowley discloses a golf teaching and practice device comprised essentially of a series of slidingly oriented measuring rules arranged parallel and transverse to each other and adjustably slideable with respect to each other through central holders. The operation appears to be essentially similar to some of the prior devices such as, in particular, the earlier Graham arrangement.

U.S. Pat. No. 2,777,697 issued Jan. 15, 1957 to E. A. Crossot discloses a simplified golf instruction apparatus including a stance mat and a measuring scale which extends forwardly from the stance mat, upon which mat the golfer stands, toward or past the position of the ball, which may be adjusted, depending on the type of shot which is to be taken, including the golf club used and the like. The adjustability is basically by a pegboard-type adjustment depending upon the physical dimensions of the players.

U.S. Pat. No. 2,790,642 issued Apr. 30, 1957 to A. T. Rolfe discloses a so-called putting guide having a central arrow indicator at the end of which the ball is placed plus two transversely extending foot stops into which the ends of the two feet of the golfer are placed and a stroke guiding member which may be adjusted according to an indexed partially arcuate indexing section. After the device is set up, the golfer directs his club or stroke along the guide member which has also been preset to the correct angle of the desired stroke.

U.S. Pat. No. 2,886,326 issued May 12, 1959 to C. E. Olds discloses a golfer's stance gage in which a series of sliding members may be adjusted for varying widths of stance and distances of the ball from the end of the device. Otherwise, the device appears to be substantially similar in concept to some of the previously described devices. Its particular aim is to arrange the foot of the golfer in the proper stance.

U.S. Pat. No. 3,041,075 issued Jun. 26, 1962 to R. L. Taylor discloses a golf instruction device comprising a central base member with a scaled surface, two adjustably pivoted foot guide members, plus a string or line-type connection to the golf tee from which the golf ball is to be struck. The index marks allow the foot guide members to be changed to different positions depending on circumstances. The device uses a series of round posts inserted through openings in the elongated base member to hold it in place while it is being used. Such ground members may be golf tees inserted through the openings in the base member.

U.S. Pat. No. 3,141,675 issued Jul. 21, 1964 to G. W. Street discloses a so-called golfer's foot positioning device comprising essentially two indexed elongated guide members pivoted together at one end plus a transverse index member also pivoted at the end and arranged to be placed in a transverse position during use of the apparatus. The pivot section may have a pointed pin or spike extending from the end which is pushed into the ground to hold the guide in general against accidental displacement during use. The arms of the device can be brought together about the pivot pin when the device is not being used in order to take up less room in storage.

U.S. Pat. No. 3,343,268 issued Sep. 26, 1967 to R. T. Schennum has a series of guides pivoted to a rectangular plate. Such foot and ball guides may be extended at various angles from the plate, which angles are indicated by indexing placed upon the plate in conjunction with pointers attached to the pivoting members through the pivot pin. One of the pivoting guide members is mounted upon a section of the rectangular plate which has been cut out from the main portion of the plate and may be moved away from such main portion upon a slide which slides within the interior of the plate. The main body portion of the plate is not a solid plate, but is comprised of an upper portion and a lower portion with an opening between the two in which the sliding section may move and the pivoting section may move and the pivoting sections may be recessed.

U.S. Pat. No. 3,384,377 issued May 21, 1968 to R. L. Stipp discloses a golf stance guide comprising a central circular component including an upper plate and a lower plate with two index foot guides extending from opposite sides. The extended foot guides are pivoted in the center of the plate so that when the guides are positioned against the inside of the instep of the golfer, the stance may be changed by moving the foot forward or backward in accordance with indexing provided on the surface of the circular plate. There are no pointers pointing either in the direction of the desired travel of the ball or in the direction of the ball as it lays on the ground. The device of Stipp is restricted purely to having foot guide members pivoted on the central circular member. However, there is indexing with respect to the foot guide positioning. Ground-piercing spikes or pins 87 may be used on the bottom of the base of the circular member in order to hold it in place on the ground during use. The index may have indications of positions to attain "slices" and "fades" as well as "draws" and "hooks".

U.S. Pat. No. 3,658,344 issued Apr. 25, 1972 to Q. Kimble discloses a golfer's stance gage having an elongated rectangular shape and appearing somewhat like an adjustable carpenter's guide or square. Foot guides comprising a wire construction are slidingly mounted in grooves along the longitudinal extent of the guide and a ball position guide comprising a long wire with an arrow indicating the desired direction of flight of the ball at the end is provided extending from a central portion of the guide and indexed along an arcuate portion.

U.S. Pat. No. 3,679,206 issued Jul. 25, 1972 to H. G. Shambaugh discloses a golfing aid comprising a base having an upward arcuate extension together with a pivoted pointer arranged so it can be set at different angles to indicate the flight of a ball. The upwardly extending casing is in the form of a round, half circular structure formed of two adjacent plates with a space between them in which the pointer is pivoted. The device is used to calculate the stroke of the golf club when the flight of the ball must be high in order to clear an elevation in the topography on the line of flight of the ball. By lining up the pointer with the edge of the elevation and taking the reading from index points the angle of the face of the club which should be used for the shot can be obtained based upon prior calculations.

U.S. Pat. No. 4,257,608 issued Mar. 24, 1981 to C. R. Funk discloses a golfer's set up device comprising a series of measuring bars, both pivoted together and attached to a sliding clevis-type arrangement. In use, the desired position of the feet can be determined by pivoting members and the distance of the ball from the transverse sliding member. The device is, therefore, essentially an updated version of some of the earlier "yardstick-type" golf aids.

U.S. Pat. No. 4,354,683 issued Oct. 19, 1982 to R. F. Woolland discloses a golf stance positioning aid again comprising two cross indicating pointers with various indexes and indications of clubs to be used marked on the surfaces. The device is also essentially an updated form of some of the earlier devices.

U.S. Pat. No. 4,434,983 issued Mar. 6, 1984 to F. K. Taggart discloses a golfer's stance mat which essentially comprises a mat having an indication on the surface essentially of indexed vertical and horizontal measuring surfaces plus an adjustable foot guide which is pivoted in the center and may be adjusted. As in most of the other arrangements, there are a number of index points along the measuring surfaces.

U.S. Pat. No. 4,538,815 issued Sep. 3, 1985 to R. G. Poirier discloses a golf stance gage including foot position indicators plus a pivoted ball position indicator having index marks along it and also provided with a transverse pivoting member which will measure not only the distance from the main base, but also the position of the ball transverse of such base.

U.S. Pat. No. 4,544,161 issued Oct. 1, 1985 to F. W. Guendling discloses a training aid for hitting golf balls comprising a device having the appearance of a carpenter's T-square which is attached to the ground by spike means. There are also openings in the device so that the golf tee can be placed in a series of positions along the top portion of the guide at various index points.

U.S. Pat. No. 5,014,994 issued May 14, 1991 to D. W. Peters discloses a golf trainer including a rather complicated U-shaped base having foot positioning extensions from one side and an open center where a golf club can actually enter between the tubular guides to strike the ball. A number of prior art patents are listed in the introduction to the specifications of the Peters patent.

Two further U.S. patents, namely U.S. Pat. No. 3,868,116 issued Feb. 25, 1975 to D. M. Ford et al. and U.S. Pat. No. 4,544,160 issued Oct. 1, 1985 to R. A. Miner, are directed to golf putting aids having a general U-shape similar to the Peters golf trainer. All the devices using parallel guide arms are intended to guide a golf stroke, either a drive stroke or a putting stroke, between such parallel arms.

While the foregoing prior art patents describe various golf aids which provide various advantages and improvements in the game of golf for the average golfer, none has been outstandingly successful. Either such former devices have been too complicated and difficult to use or they have not addressed sufficient of the main problems of attaining a consistent golf stroke. The present inventor, on the other hand, has devised a golf training aid which is not only a precision instrument, but can be adjusted for almost any playing eventuality. The device of the inventor, which is essentially universally adjustable, easily changes the adjustment of points indicating the position of the feet, the ball and the target by a preset or adjustable number of degrees and can be adjusted to provide the same contact between the golf club face and the golf ball with several alternative adjustments to allow for the idiosyncrasies of each golfer. The device is also provided with a special club face angle indicator that is universally adjustable to allow for a number of club face settings and may be adjusted also for the loft of the golf club.

OBJECTS OF THE INVENTION

It is an object of the invention, therefore, to provide a golf aid device having a series of pointers, each of which can be easily and conveniently arranged at a preferred angle with respect to the other pointers to precisely indicate to the golfer how to address the ball.

It is a further object of the invention to provide a golf alignment device which is universally adjustable in equal increments such that several different combinations of positions of the alignment device can be used alternatively to monitor individual golfers' stances to address the ball and to reproduce successful strokes.

It is a further object of the invention to provide a golf aid which can be set to indicate the essential parameters of a golfer's body stance and address to the ball by which a successful stroke can be duplicated.

It is a still further object of the invention to provide a golf stroke calibration device having a central mounting from which pivoted indicators extend to indicate the target direction, the ball position prior to striking such ball and the proper foot position.

It is a still further object of the invention to provide a golf stroke calibration device having a central pivoted mounting wherein a target pointer is centrally mounted to serve to align a golfer's attention upon the direction in which the ball is to be struck plus individual pivotally mounted ball and foot position indicators extending during use generally perpendicularly to the target pointer.

It is a still further object of the invention to provide a golf training device having a central indexed hub to which are pivoted-a target pointer, a foot pointer and a ball pointer, the central hub having calibrated indicia to indicate the relative direction of extension of each of the pointers with respect to the hub and with respect to each other.

It is a still further object of the invention to provide a golf training device having a central hub to which are pivoted a target pointer, a foot pointer and a ball pointer and having a club alignment head mounted upon the ball pointer.

It is a still further object of the invention to provide on a ball pointer associated with a golf training device a club face aligner which is adjustable in accordance with indicia showing the relative alignment of the club face aligner with such ball pointer.

It is a still further object of the invention to provide a golf training aid having a central hub with pivoted pointers extending therefrom and a club face aligner supported upon a pointer extending from said hub with indices upon the hub providing indications of the setting of the pointers and indices associated with the golf face aligner to indicate the setting of the said aligner.

It is a still further object of the invention to provide a golf training device having a club face aligner mounted upon a ball aligner, said club face aligner being adjustable both with respect to transverse alignment of the club face and vertical inclination of the club face.

Other objects and advantages of the invention will become apparent from the following description and appended drawings.

SUMMARY OF THE INVENTION

The present invention provides both a golf training aid having a centrally pivoted target pointer as well as a ball pointer and a foot pointer centrally pivoted and, in addition, a golf club face aligner mounted upon the ball pointer. The two principal parts of the apparatus can be used both alone and together. The centrally pivoted pointers are preferably pivoted to a central hub construction having a shroud or cover over the top upon which indices of the pivot angle of the pointers may be noted. The pointers are individually adjustable to adapt to different positions of the golfer's feet, i.e. the golfer's stance, as well as the ball with respect to the target. The club face aligner is preferably mounted upon the ball pointer at a position where the face of the club can conveniently contact it during preliminary alignment of the club face before addressing the ball. The club face alignment indicator can be either initially aligned with the club face to essentially initially record the club face angle or a series of consecutive angles or the club face can be aligned with a preset club face aligner, if such aligner is being used to align the club face to correspond with a previous stroke. The club face aligner is very preferably horizontally rotatable or adjustable both left and right and is also preferably rotatable about the ball pointer or adjustable with respect to a vertical direction to adjust to loft of the club face.

BRIEF DESCRIPTION OF THE DRAWINGS

FIG. 1 is an isometric view of the preferred form of the golf training and practice device of the invention.

FIG. 5 is an enlarged plan view of the club face aligner shown in FIGS. 1 to 3 with the outline of a ball just beyond.

FIG. 12 is a diagrammatic plan view of a club head being aligned with a club face aligner and diagramming in addition the intersection of the circular golf club swing path with the linear path of the ball.

FIG. 13 is a diagrammatic perspective view further showing the angle of the circular club swing with the straight ball path.

FIG. 14 is a plan view of an alternative hub index face in the form of a cross rather than a circle.

DESCRIPTION OF PREFERRED EMBODIMENTS

Figure 2:
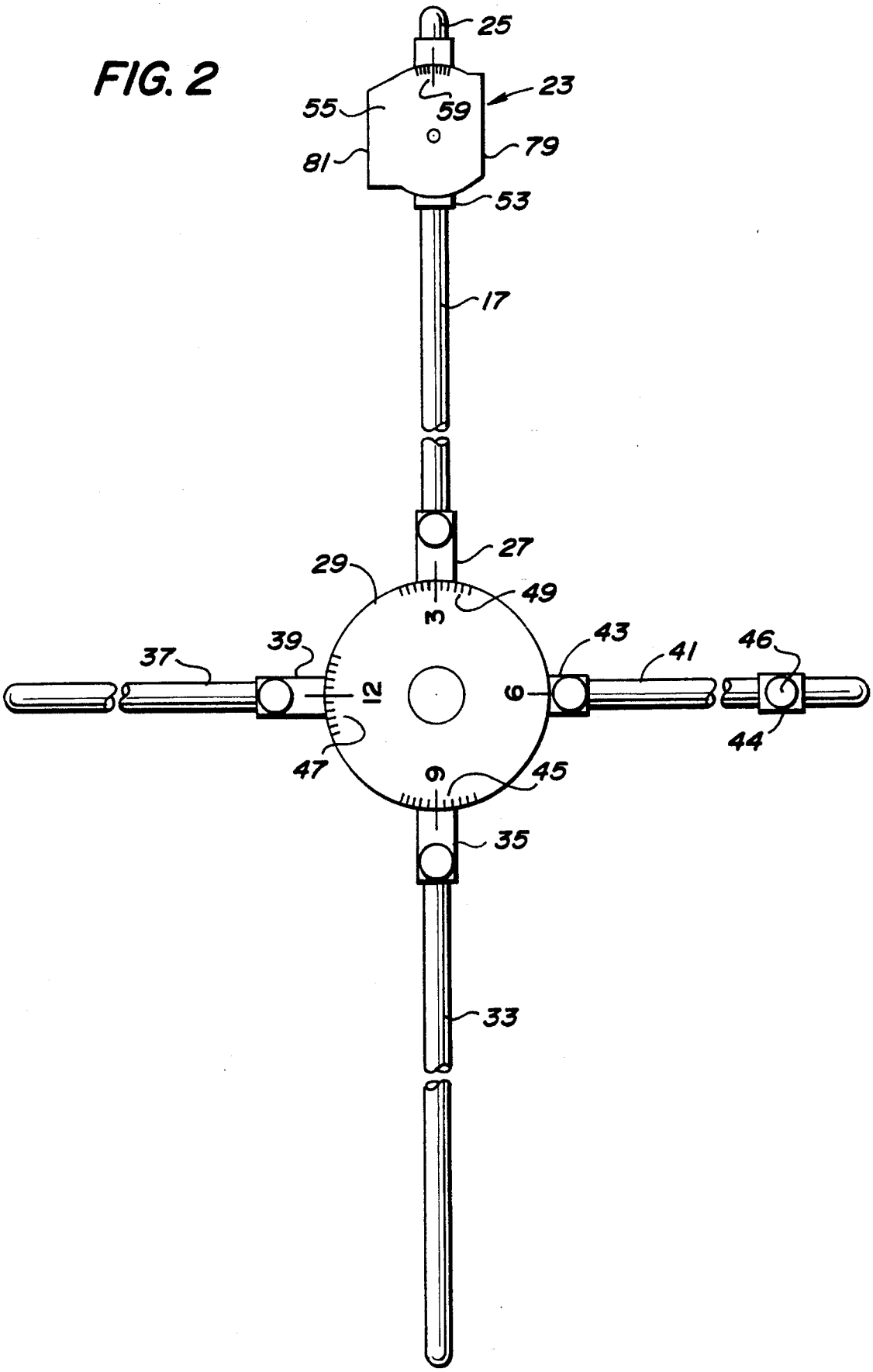
FIG. 2 is a plan view of the embodiment of the invention shown in FIG. 1.

As indicated above, there have been a great number of various apparatus and devices devised for aiding instruction in the game of golf. Many of such devices are calibrated-yardstick-type devices basically substituting for the use of two crossed golf clubs which have been used for many years as a teaching aid to enable the student of golf to visualize the direction in which the ball is to go with regard to the lay of the ball just before the golf stroke and the stance which the feet of the golfer should take in addressing the ball. A number of patents describing various golf devices basically substituting for the two crossed golf clubs have been described above. As noted, most of these devices have been basically of the calibrated-yardstick-with-appendages-type. However, there have also been devices incorporating alignment means which are pivoted on a more or less central hub arrangement and in which the positions of the-alignment means with respect to each other may be monitored or defined with respect to indicia provided on the central hub or other means. However, while such centralized hub and pivoting alignment means have proved to be useful, they have not solved the general problem of maintaining the proper stance and addressing of a golfer to the ball in order to obtain reliable and reproducible flight patterns of the ball.

The present invention has provided a considerable improvement upon the previously available apparatus for aiding visualization of the flight of the ball and address of a golfer to the ball during the game of golf. The apparatus of the invention, as explained above, comprises two principal parts which may be used preferably together, but which are also useful when used by themselves or in conjunction with other golf training equipment.

The first of these golf aids is an arrangement of a central hub, preferably circular, but also formed in other possible configurations, upon which hub three separate and cooperating pointers are pivoted, essentially at right angles to each other and which preferably have index points or indicia which indicate the angle of each pointer when pivoted beyond right angles with each other. By the use of the apparatus of the invention, the golfer's address to the ball and general stance can be made both reproducible from one address to the ball to another and the golfer also can be aided in initially attaining the best possible address to the ball obtainable for causing the ball to travel in the direction desired. The device is also very effective in aiding mental visualization or imaging by the golfer of the relationships which are important to attain a satisfactory or desired flight of the ball.

The second portion of the invention, which is used preferably in conjunction with the first portion of the invention, comprising a central hub with pivoted indicators, is a club face guide which is designed to be mounted upon the ball indicating pointer either of the present invention or the ball indicating pointer of another golf training device in a position adjacent the end of the pointer such that the angle of the striking head of the club can be pre-aligned in the desired position to place it in the correct alignment for striking a golf ball in order to urge such ball to travel in the direction desired. Since, as explained above, there are only three basic arrangements of the club face when striking the ball, which result in several different paths of flight for the ball, a mere setting of the club face guide by means of the indicia provided on said guide serves to either encourage the ball to fly straight, to turn progressively to the left due to the spin on the ball, or to turn progressively towards the right. Depending upon the amount of spin which is placed on the ball, which depends in turn upon the angle of the club when it hits the ball, the ball will travel in more of an arc and farther to the side of its original flight path before it hits the ground. If it is hit to the left initially with an out-to-in swing and then curves back towards the right, it will be referred to as a slice. If it travels back toward the original line of sight to the target, but not beyond, it will be referred to as a fade. Likewise, if the ball is initially hit towards the right with an in-to-out swing and travels back in the opposite direction more than the original line of sight to the target, it will be known as a hook, while if it initially goes to the right and then curves back toward the original line of sight, but less than to such original line of sight it will be called a draw. Thus a draw will originally be struck with a less inclined golf head to the right than a hook and a fade will be struck with a lesser inclination of the golf blade at the moment of impact to the left than a slice. If it is desired to have the golf ball travel completely straight, the golf club surface or club face aligner, referred to hereinafter sometimes as the C.F.A., will be arranged to be exactly at right angles with the swing of the club so that the ball will be hit squarely and travel exactly in the direction in which the club was originally traveling when it hit the ball. These relationships will be made clear with reference to the attached drawings and the following description of such drawings.

FIG. 1 is an isometric view of a golf training and practice apparatus 11 opened into operating position on the ground 13 with a golf ball 15 positioned at the end of a ball pointer 17. A golf-club 19 having a striking head 21 is shown in outline adjacent to the ball pointer 17 approximately adjacent to a club face aligner 23 near the end 25 of the ball pointer 17. The ball pointer arm 17 is preferably, as shown, mounted by a screw jam arrangement in a pivoting base member 27 which may be pivoted to a central indexing hub 29 and an indexing hub base 31 at a pivot point 33, better indicated in FIG. 3. The combined central indexing hub 29 and indexing hub base are broadly indicated as the central hub 26. Likewise, a foot pointer 33 is mounted in a pivoting foot base 35 and the target pointer 37 is mounted in a target base 39. A tail or target pointer tail 41 is mounted in the opposite ends of the target base 39, it being understood that the target base 39 extends entirely through the central hub 26 formed by the central indexing hub 29 and the indexing hub base 31. Thus the target base 39 is mounted or pivoted between the central indexing hub 29 and the indexing hub base 31 on a central pivot between the central indexing hub and the indexing hub base 29 and 31 respectively. For convenience in reference, the tail end of the target base is denoted by reference numeral 43. A foot position indicator ring 44 having set screw 46 may be mounted upon the target pointer tail for a purpose which will be hereafter made clear.

An enlarged plan view of the golf training and practice apparatus as shown in FIG. 1 is shown in FIG. 2. In FIG. 2 it can be seen that the central indexing hub 29 has index points at three locations, namely, adjacent to the base 27 of the ball pointer 17, adjacent to the pivoting foot base 35 of the foot pointer 33 and adjacent to the target base 39 of the target pointer 37. No indexing is provided adjacent the target pointer tail base 43 which is a portion of the target pointer base 39, since the target pointer tail 41 as well as the base merely follow the target pointer 37 and target pointer base 39. However, it will be evident that indexing could be provided on the central indexing hub adjacent to the target pointer tail base 43 as well to supplement the indexing 45 for the target pointer. Alternatively, the indexing for the target pointer could be adjacent to the target pointer tail base 43, since the target pointer tail base 43 and the target pointer base 39 are, in fact, preferably a single member extending completely through the central hub 30.

It will also be noted that the various indices denoted by reference numerals 45, 47 and 49 have been assigned central indices which are ninety degrees apart from each other, in general arbitrarily designated "twelve o'clock", "three o'clock" and "nine o'clock" or, as actually shown, "12", "3", "6" and "9" analogizing these points to the military system of indicating direction by clock points made popular by the U.S. Air Force. A single central index point or line adjacent the target pointer tail base 43 is also assigned a designation of "six o'clock" or "6" to maintain the overall symmetry of the indexing system. It will be understood that each one of the divisions of the indices may be arbitrarily assigned a number, letter or other designation and that such indices all preferably have equal divisions. Alternatively, the divisions may be unequal divisions and/or may be designated as those indices for particular types of flight of the golf ball. For example, a "hook", a "draw", a "fade" and the like could be additionally designated on the indices, but this is not preferred, because different golfers may have different swings with the same alignment and the device is arranged to compensate for this. Preferably, the indices markings will, for convenience, be four degree designations, which may, for convenience, be designated merely as "degrees". It is important that all index designations be an equal number of degrees apart so all index points are equal throughout the apparatus, if the most convenient and effective use of the device is to be made .

FIG. 2 also shows grasping heads 51*a*, 51*b*, 51*c* and 51*d* for threaded jam members 52*a*, 52*b*, 52*c* and 52*d* which hold the various pointers 17, 41, 33, and 37 within the base members 27, 43, 35 and 39. The use of the threaded jam members enables the various pointers to be removed from their bases so that the apparatus can be stored more conveniently or adjusted by use of different length pointers and the like. In normal usage, as will be explained hereinafter, only one of the pointers, usually the target pointer tail 41, will have to be removed from the remainder of the apparatus for convenient storage. In such case, the two side pointers, i.e. the foot pointer 33 and the ball pointer 17 will be pivoted toward each other and toward the target pointer 37 to make the apparatus more compact so that it can easily be inserted into a golf bag for easy carrying on a golf course or, alternatively, into a separate case. During storage, the target pointer tail 41 will be removed from the target pointer tail base 43 (or 39) and stored separately, usually with an extra short target pointer 92 which is used with short golf clubs or short golfers. See FIG. 18 described hereinafter for a depiction of the apparatus of the invention compacted for storage or transportation.

It will be understood and made more clear hereinafter with respect particularly to FIG. 3, that the base 39 is pivoted in the center of the central hub 26 on a pivot, not visible in FIGS. 1 or 2, but visible in FIGS. 3 and 4. The ball pointer base 27 and foot pointer base 35, however, are not directly attached to each other and may be folded on their pivots 56 and 54, respectively, within the hub 26 to a position more or less parallel to each other or even inclined towards each other somewhat and extending adjacent to either the target pointer 37 or the target pointer tail 41 so that the entire golf practice apparatus may be easily inserted into a golf bag. In such instance, either the target pointer tail 41 or, alternatively, the target pointer 37 itself may be removed from the remainder of the apparatus by loosening the set screws 51*b* or 51*d*, respectively, and removing such pointers. Alternatively, the pointers 37 and 41 can be left in place. In one ornamental version of the apparatus, not shown, the target pointer tail 41 may, in fact, be formed in the shape of a golf club handle so that it may be left upon the apparatus and extend upwardly in a golf bag so it may appear to be the top of a golf club rather than a training device.

Toward the end of the ball pointer 17, there is shown a club face aligner 23 which is preferably constructed in two separate parts. The first portion of the club face aligner is a base 53 which incorporates a central cylindrical orifice through which a portion of the ball pointer 17 may be inserted so that the base 53 is mounted upon the ball pointer and rotatable with respect to the ball pointer. On top of the base 53 there is a club face aligning member 55 attached to a central portion of the club face aligner base 53 by pin 57 which is preferably a threaded pin or a threaded bolt. Pivoting of the club face aligner member 55 upon the threaded pin 57 allows the club face aligner member to rotate horizontally with respect to the apparatus and to be set at various angles with respect to the ball pointer. A club face aligner index 59, shown more particularly in FIG. 2, provides for adjustment of the club face aligner to various angles.

Figure 3:
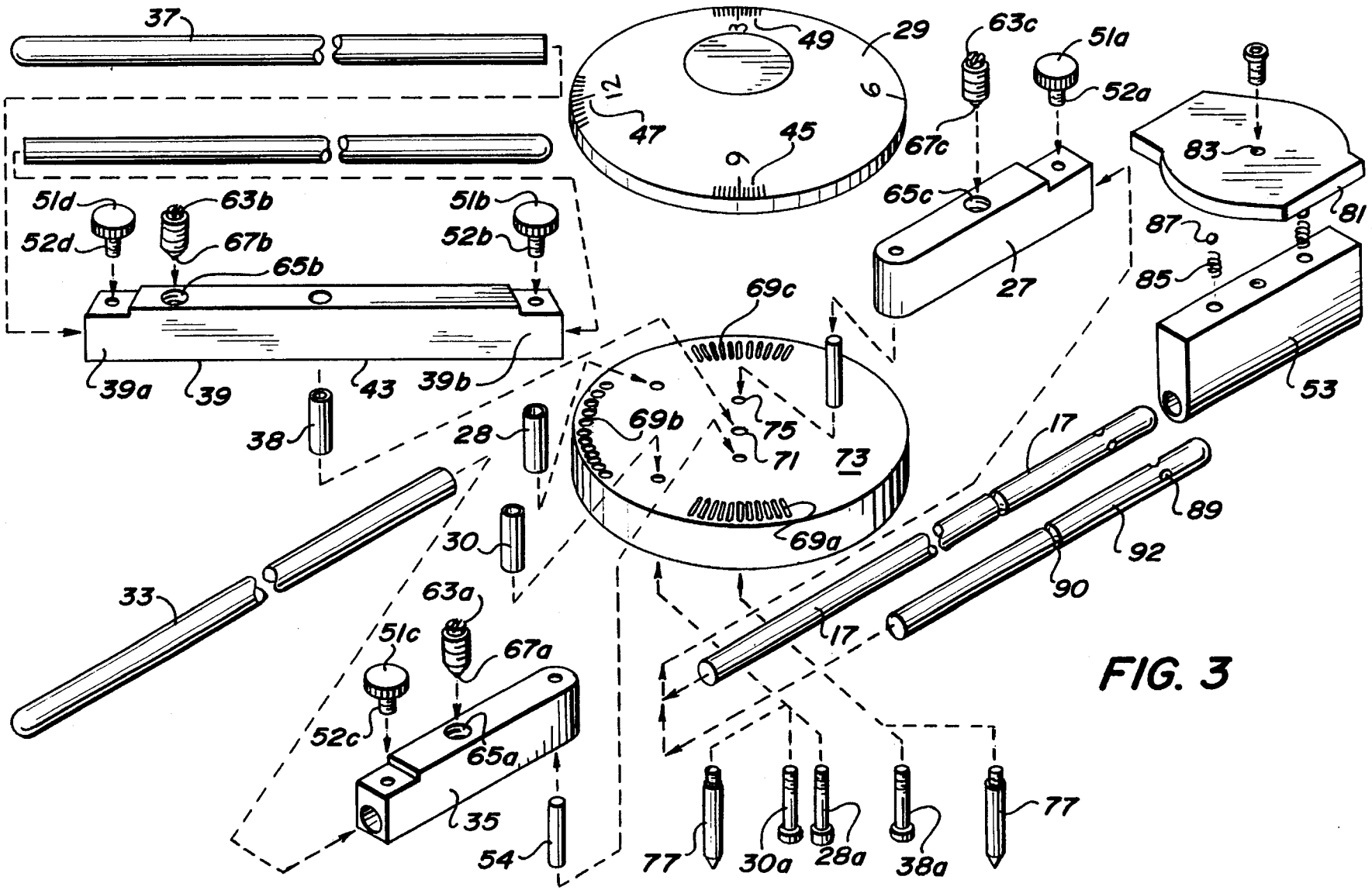
FIG. 3 is an exploded view of the golf training device shown in FIGS. 1 and 2.

In FIG. 3, there is shown an exploded view of the golf training and practice apparatus in accordance with the present invention. In FIG. 3, it will be noted that the indexing hub base 31 is mounted adjacent the lower portion of the target pointer base 39 which has a target pointer tail end 39*b* and target pointer end 39*a*. Target pointer tail base 39*b* is the same as base 43 in those views where the entire base 39 cannot be seen extending completely through the hub 30. On the other or upper side of the target pointer 39 is mounted the central indexing hub 29. There are three connections between the central indexing hub 29 and the central indexing hub base 31. The first of these is a pivot pin in the form of a machine bolt 38*a* which extends through a bushing 38 which in turn extends through and provides rotation capability to target pointer base 39. The end of the machine bolt 38*a* is then threaded into the bottom of the central indexing hub 29. In addition, two further machine bolts 28*a* and 30*a* pass through the central indexing base 31 and pass through spacers or ferrules 28 and 30 and are then threaded into the bottom of the central indexing hub. The ferrules 28 and 30 serve as the spacers which establish the distance between the central indexing hub 29 and the hub base 31. Pivot pins 54 and 56 serve to pivotally attach the foot pointer base 35 and ball pointer base 27 to the indexing hub base 31 and central indexing hub 29. As seen in FIG. 3 and explained previously, the outward position of the pivot pins 54 and 56 with respect to the central hub base 31 and central indexing hub 29 serve to allow the bases 35 and 27 for the pointers 33 and 17 to pivot more than 90 degrees between the indexing hub base and central indexing hub in order to fold the bases and pointers for storage or transportation. A series of threaded detents springs 63*a*, 63*b* and 63*c* are mounted in orifices 65*a*, 65*b* and 65*c* in the foot pointer base 35, the tail pointer base 39*a* or 43 and the ball pointer base 27. Each of these has been provided at one end with a small spherical detent 67*a, b* and *c* which are pressed by the weight of the arm and pointers so the detents 67 at the ends contact with a series of grooves, indentations or other detent receiving openings which tend to hold each one of the bases in a set position once the detent 67 slips into one of the depressions of each series of detent depressions broadly designated by the reference numerals 69 or more particularly 69*a*, 69*b* and 69*c*. The detent pressure or force can be adjusted by rotating the threaded detents 63*a*, 63*b* and 63*c* either way in the threaded orifices.

The top face of the indexing base hub with these series of detent depressions 69*a*, 69*b* and 69*c* upon the inside face of the such indexing hub base 31 is shown in FIG. 3 which also shows the position of the central orifice 71 for receipt of the pivot pin or bolt 38*a* and the side orifices 73 and 75 for receipt of the pivot pins 54 and 56.

FIG. 3 also shows two, pointed metal tees 77, which are screw threaded into the bottom of the indexing hub 31 and serve as ground penetrators which are inserted into the ground upon which the golf training and practice apparatus is placed, securing said apparatus to the ground so that it will not slide or be otherwise displaced when changing the indexed positions of the various pointers. When it is not wished to secure the apparatus to the ground or it is desired to store the apparatus in a golf bag or otherwise transport it or the like, these metal tees 77 can be unscrewed from the bottom. Alternatively, it will be understood other arrangements for providing sharp ground penetrators on the bottom of the indexing hub base 31 can be adapted. For example, the ground penetrating metal tees can be hinged to the bottom of the indexing hub base 31 and held in a known manner by a snap position enabling them to penetrate the ground when desired, but to be folded to the side and even embedded into openings in the base when it is not desired to make use of them, and particularly when the apparatus is being handled or transported.

Figure 4:
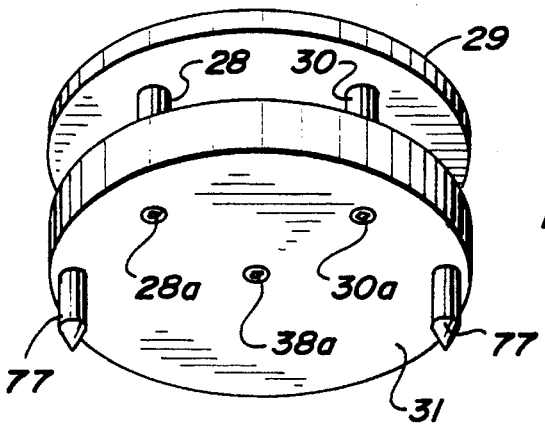
FIG. 4 is an enlarged view of the underside of the indexing hub base of the golf training and practice device.

FIG. 4 is an isometric view of the bottom of the indexing hub base showing the penetrating metal tees 77 in place plus the position of the other bolts 28*a*, 30*a* and 38*a* which serve to hold the indexing base hub 31 and central index hub together with intervening spacers.

FIG. 5 is an enlarged plan view of the club face aligner 23 shown in FIGS. 1, 2 and 3 showing that the upper portion of the club face aligning member or upper portion of such club face aligner, designated as the club face aligning member 55, has two flat sides 79 and 81. This club face aligner, which has been broadly explained with reference to FIGS. 1 and 2, is pivoted at pivot point 83 to a base member 53 which is in turn, rotationally adjusted upon the ball pointer 17. The base 53 of the club face aligner, is also provided with springs detents and associated detent members in the form of small spheres, not shown which catch in a series of depressions 89, similar to the depressions 69 in the face of the indexing hub base, in the outer surface of the ball pointer and prevent the base of the club face aligner 53 from rotating freely upon the ball pointer, but allow such rotation when it is desired to adjust the club face aligner in discreet increments. A second pair of the springs and detents operate or slide in a groove 90 on the surface of the pointer 17 to retain the base 53 upon the pointer unless sufficient endwise force is exerted to pull the base 53 from the pointer 17.

Likewise, the club face aligner base 53 is provided on its upper side with orifices 91 in which there are provided, as shown in FIG. 3, coiled springs 85 or detent springs which act together with detents 87 to prevent over-rotation of the club face aligner member 55 and provide indexed motion or adjustment of such club face aligner 55. It will be understood that the club face aligner member will on the bottom have a series of detent impressions, not shown, into which the detents 87 will be forced by the springs 85 as the detent depressions pass over the orifices 91. This allows the club face aligner member 55 to be rotated only in small increments suitable for changes and alignment of the golf club head in addressing the ball. Likewise, the detent impressions 89 on the ball pointer allow the angle of the club face aligner to be changed with respect to the vertical orientation or inclination of the club face aligner. It will be understood that the detent depressions in every case will be arranged to be at a distance from each other which will allow the club face aligner to be adjusted to a sufficient number of positions to basically take care of all eventualities with respect to the angle of the club face aligner.

In FIG. 5 it is seen that there are indices at both ends of the club face aligner member which allow the rotation of either end of the club aligner to be turned to an appropriate number of degrees to obtain the desired adjustment of the club face aligner and therefore the club face, when it is set against such aligner, to provide the desired flight of the ball. It will be recognized that the index marks may be either arranged to be at set distances from each other coordinated with the number of detent depressions on the opposite side of the golf club face aligner member or may have greater space between the indices than the depressions. There would be little purpose, however, in having the indices closer together than the arrangement of detent depressions would allow adjustment of the club head aligner. As shown, the indices are preferably at four degree intervals matching the preferred intervals of the various pointers on the central hub of the golf alignment apparatus.

It will be understood that while a preferred form of the club face aligner has been shown and described, that other effective embodiments of the club face aligner could also be designed and constructed. Furthermore, while the club face aligner 23 has been shown in conjunction with applicant's preferred central hub-type ball indication device, it will be understood that the club face aligner could also be mounted upon other types of ball indicating pointers and the like. The requirements for the club head aligner are merely that it be adjustable to a desired angle and held at that angle while the club face is tested, aligned or angled against it, after which the club face can be pushed forward to the location of the ball preparatory to swinging the golf club and striking the ball. In other words, the club face is normally first addressed to or matched against the club face aligner and then pushed forwardly and addressed to the ball preparatory to the golf swing while maintaining the same club face angle as was initially established against or with reference to the club face aligner, or C.F.A. While it is usually preferable to actually contact the club face aligner with the club face, it will be understood that the two can also be merely brought close to each other and, in effect, "eye-balled" together.

It should also be understood that the club face aligner, while shown positioned substantially at the end of the ball pointer, but inwardly of the actual position of the ball during a stroke of the club, could also be positioned so that it would be originally substantially at the position of the ball and then retracted from such position allowing the club which has been aligned with the club face aligner to be merely swung in an arc and brought forward to strike the ball while still being held in the same position.

Figure 6:
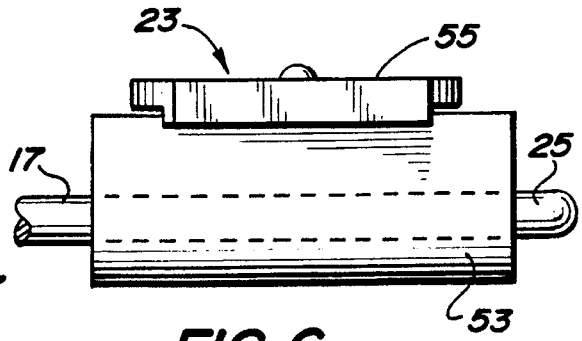
FIG. 6 is an enlarged side view of the club face aligner shown in FIG. 5.

Likewise, while a preferred embodiment of the club face aligner is shown which is vertically alignable to adjust for the loft of the club, i.e. the upward inclination of the club face, as well as angularly inclined to determine the transverse angle of the club, such loft adjustment is not as important as the left and right adjustment to provide orientation of the club face to either hook or slice the ball or other flights of the ball. Thus, the C.F.A. may be merely adjustable right or left. In some cases, it may also be desirable to have a more extensive side surface on the club face aligner so that the vertical inclination of the club face can be more easily matched with the vertically inclination of the club face aligner. This is particularly so when it may be desired to use a club face aligner which has been preset for previous strokes by the same golfer to not only aid in addressing the ball correctly, but also in selecting the particular loft of the club which is to be used to strike the ball. However, in general, as indicated above, it is more important to precisely indicate the left or right inclination of the face of the club rather than the loft of the club, since the loft of the club is a preset condition basically of the club face construction which may be selected before hand, while the left or right inclination of the club head at the time of striking the ball depends on the particular grip of the golfer on the club at the time the ball strikes the club. On the other hand, while less desirable, the right and left adjustment of the C.F.A. may also be made by changing the angle of the ball pointer upon which the C.F.A. is mounted. As the club face aligner is set up in FIG. 5 as well as in FIG. 6, which is a side elevation of the club face aligner shown in FIG. 5, the direction of the flight of the ball is indicated by the arrow 97.

Figure 7:
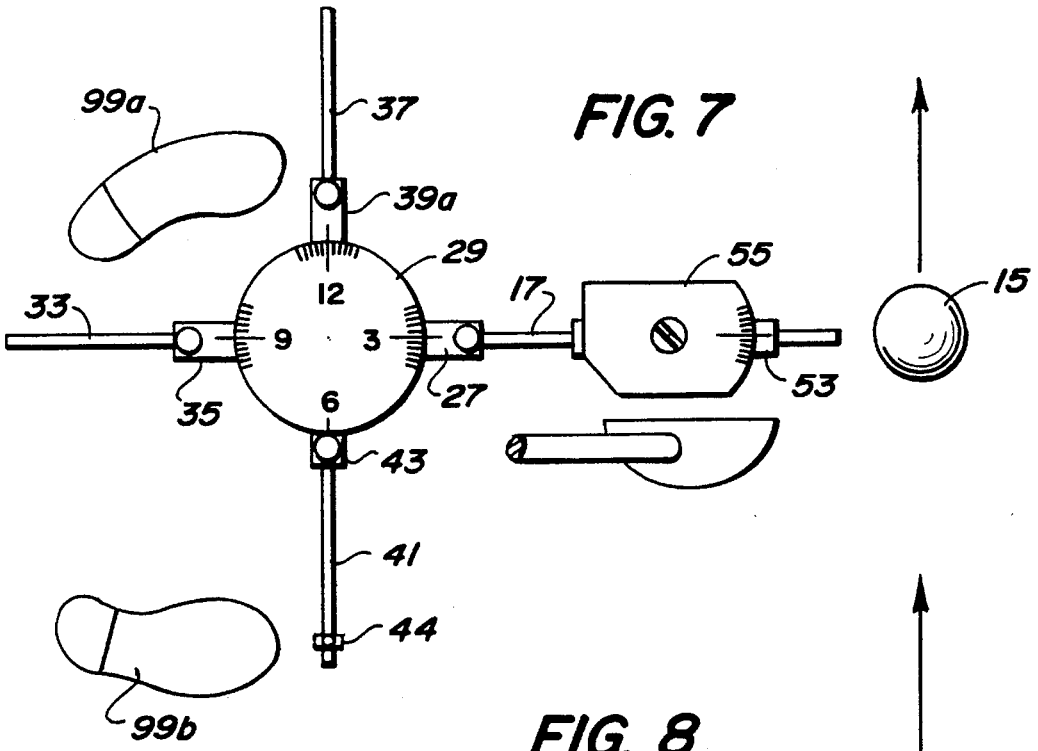
FIG. 7 is a diagrammatic plan view of the apparatus of the invention used during addressing of the ball preparatory to swinging.

FIG. 7 is a diagrammatic view of the apparatus of the invention showing the first step of addressing the ball with the club face aligner 23 with the ball about to be hit squarely by the club head after having been aligned by the club face aligner. In FIG. 7 the club face aligner is squared 90 degrees from the target pointer and is, in other words, set up for a straight drive of the ball 15 along the drive line 97.

In the set up of the arrangement shown in FIG. 7, the golfer, represented by the golfer's footsteps 99*a* and 99*b*, 99*a* being the left foot and 99*b* being the right foot, after having placed the golf training and practice apparatus 11 on the ground between the golfer and the golf ball, places his feet basically as shown in FIG. 7 with the toes more or less equidistant from the target pointer and the left heel near the foot pointer 33. The exact placement of the right foot of the golfer may be, if desired, indicated by positioning the indicator ring 44 at a set position along the target pointer tail 41 by the adjustment screw 46. In many cases, however, the use of indicator ring will not be found necessary. The golfer, after placement of his feet, then extends his golf club with the heel of the club resting on the ground and brings the face of the club against the golf club aligner, or C.F.A., 23 and more particularly against the face 79 of the rotatable portion 55 of the aligner 23. The face of the golf club aligner 23, in this case the face 79 of rotatable portion 55, will either have been preset at the loft angle of the club or else will be adjusted by rotation of the club face aligner 23 upon the ball pointer 17 until the face of the club face aligner is the same as the angle of the face of the golf club, or the same as the loft angle of the golf club. Since a straight drive is desired in FIG. 7 the club face aligner will also be adjusted so that its face is parallel to the ball pointer 17. With the golf club head then extended with its face against the club face aligner, or else very close to the surface of the club aligner, the golfer's grip will be adjusted upon the handle of the golf club until such grip is comfortable upon the handle with the face of the club arranged in this position. When the club handle is then firmly grasped with the grip tightened and still feels comfortable, the club head is extended forwardly from adjacent to the golf club aligner to behind the ball. In other words, the ball is then addressed. The club is extended forwardly by either extending the arms slightly or the golfer leaning over slightly more in order to bring the golf club head the short distance from the club face aligner to behind the ball. The club will still at this point, assuming that the golfer does not change his or her grip on the handle, be held with the face of the club parallel to the face of the club face aligner. The club may now be swung back away from the ball and then swung in the usual inclined arc downwardly until it strikes the ball, propelling the ball down the fairway. Since the face of the club should strike the ball squarely, the ball should be propelled directly down the fairway. However, if the ball should deviate to either side after the ball has been directly addressed as shown in FIG. 7, the club face aligner may be adjusted to bring the club face slightly into an orientation opposite to that which the ball has taken during initial portions of its flight. The club face is then addressed again to the club face aligner and aligned in the same manner as before until the club feels secure and then addressed to the ball in the same manner and the golf club swung in the usual arc until it strikes the ball. Since the club face has now been angled slightly in the opposite direction from which the initial flight of the ball was originally taking, the flight of the ball should be straightened out or partially straightened out by the new orientation of the club face aligner. Several trials and adjustments of the club face aligner may be necessary to determine when the flight of the ball will be straight. However, once a desirable club face aligner angle or orientation has been established for obtaining a particular flight of a ball, a very consistent result should thereafter be obtained by realigning the club face to the aligner in the same manner prior to each golf swing while maintaining the same position of the other pointers.

Figure 8:
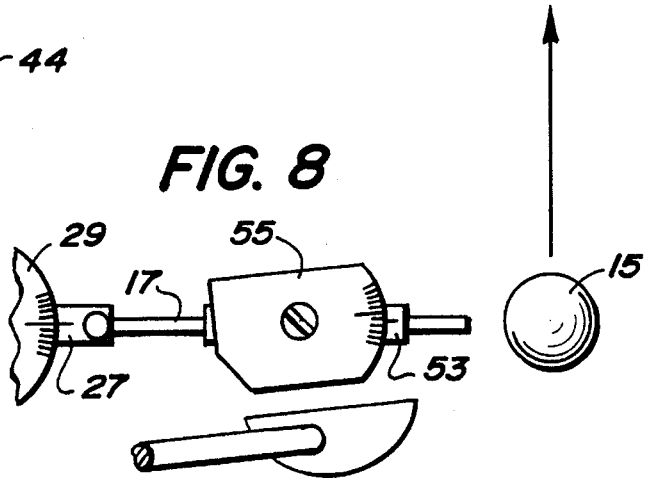
FIG. 8 is a diagrammatic plan view similar to a portion of FIG. 7 showing the club face aligner arranged to accommodate a closed club face.

FIG. 8 is a diagrammatic view of a portion of the invention showing the club face aligner 23 with the club face aligning member 55 angled slightly to the left in order to produce a hook or a draw, depending on how far the angle is inclined. As in FIG. 7, the head of the golf club will be adjusted in the golfer's hands while addressing the club face aligner so that the club face is parallel to the face 79 of the club face aligner and the golfer's grip on the handle of the golf club will then be adjusted until it is comfortable and secure. The golf club is then extended until the head addresses the ball maintaining the same grip which will maintain the golf club face closed as shown in FIG. 8. When the golf club is then swung backwardly and brought forwardly in the golf swing maintaining the same angle of the face, i.e. with a closed angle of the face of the golf club, the ball will either be hooked, i.e. will travel to the left progressively curving more severely to the left, because of the spin of the ball or, if the face of both the club face aligner and the club face itself is not angled as severely the ball will merely draw to the left before it hits the ground. In each case, if the ball does not travel as desired, the club face aligner angle can be changed to obtain different results.

As also indicated above, the club face aligner can be initially set with respect to the actual angle of the club face and the golf stroke can then be taken to see where the ball goes and then adjustments made and more strokes taken until the ball goes where it is desired. Thereafter, when the club face aligner is set to the same position, the ball again should go to the same place, assuming that the grip on the handle of the golf club remains the same and, of course, the strength or the power of the stroke is the same and assuming the wind or local air movement is the same. Alternatively, the angle of the club face aligner can be preset to a previously determined setting which it is known will cause the ball to go to a certain location or spot so long as the club face is first addressed to the club face aligner and a comfortable grip obtained and the club face is then addressed to the ball and the ball struck maintaining the same stance and grip on the club producing a predetermined flight of the ball.

As also indicated above, the angle of the club face aligner shown in FIG. 8 could also be obtained by keeping the club face aligner square with the ball pointer and inclining the ball pointer a similar number of degrees to the left. The stance in such case might be shifted also somewhat to the left together with the ball which would remain at the end of the ball pointer. However, when the club face aligner was then addressed by the golfer, the golf club aligned with such aligner as explained above and the ball then addressed in a golf swing taken at the ball, the results would be comparable, although not quite as good, because of the necessary shifting of the stance over the golf training unit practice apparatus. In other words, it is very desirable that the golfer take the same stance over the training and practice apparatus each time. Such stance will quickly be learned and will be readily reproducible by the golfer almost as a matter of course when using the apparatus. This is only possible, however, when the pivoted club face aligner which is the preferred embodiment of the invention is used. Otherwise the stance of the golfer may have to be changed slightly and while this minor change can be readily accommodated, particularly by somewhat experienced golfers, such change in stance also may change the reliability of the results obtained.

Figure 9:
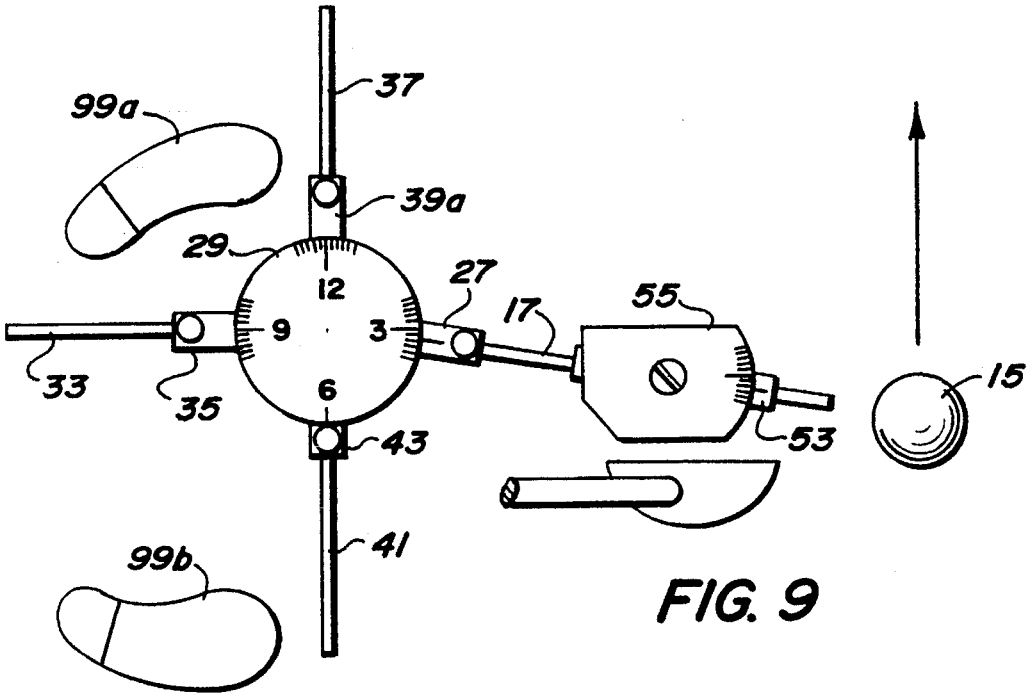
FIG. 9 is a diagrammatic plan view similar to FIG. 7 showing the club face aligner squared for straight flight of the ball, but with the pointer withdrawn for placement of the ball to the rear of the usual position.

FIG. 9 is a diagrammatical view similar to FIGS. 7 and 8, but showing the club face aligner squared first for straight flight with respect to the ball while the ball pointer upon which the club face aligner is mounted is inclined to the right. With this arrangement the ball should still travel straight along the target path, but, due to the stance which a particular golfer takes, striking a ball at the advance position may be more natural for such particular golfer and provide better results. With other golfers the advance striking position may result in so called push of the ball in which the ball will travel slightly to the right of the target line rather than directly along the target line.

Figure 10:
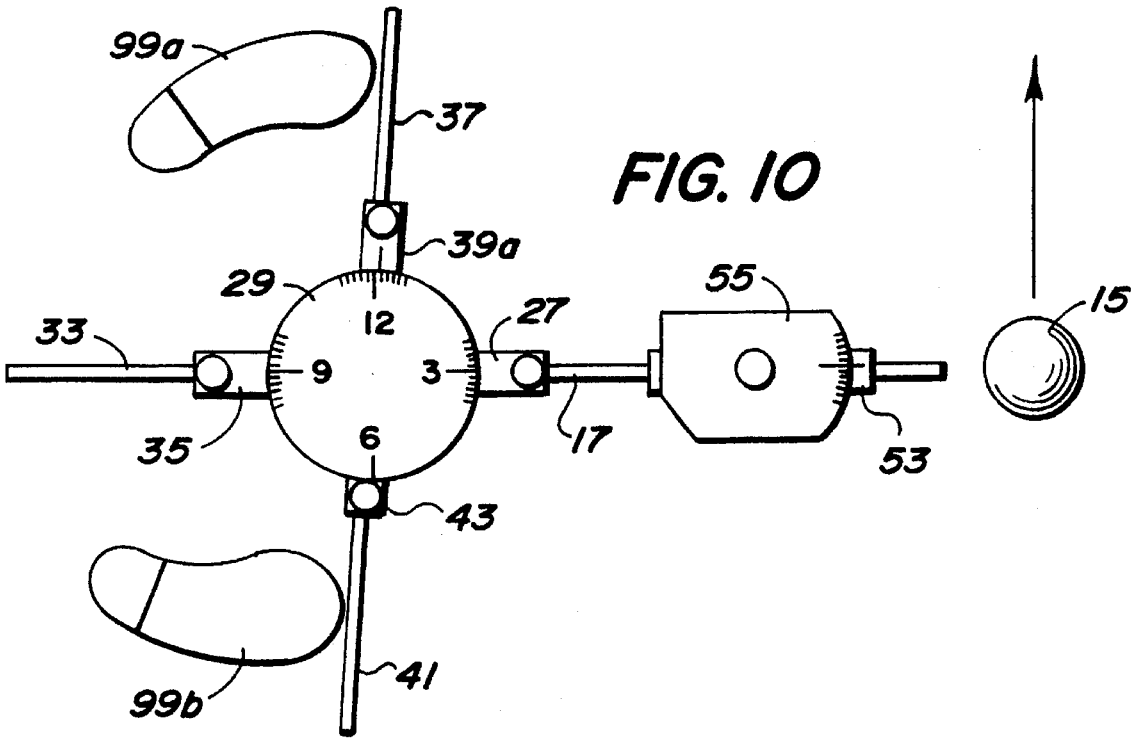
FIGS. 10 and 11 are diagrammatic plan views similar to the prior diagrammatic views showing the indexing system respectively in a closed alignment and an open alignment indexing the foot placements in such alignments.
Figure 11:
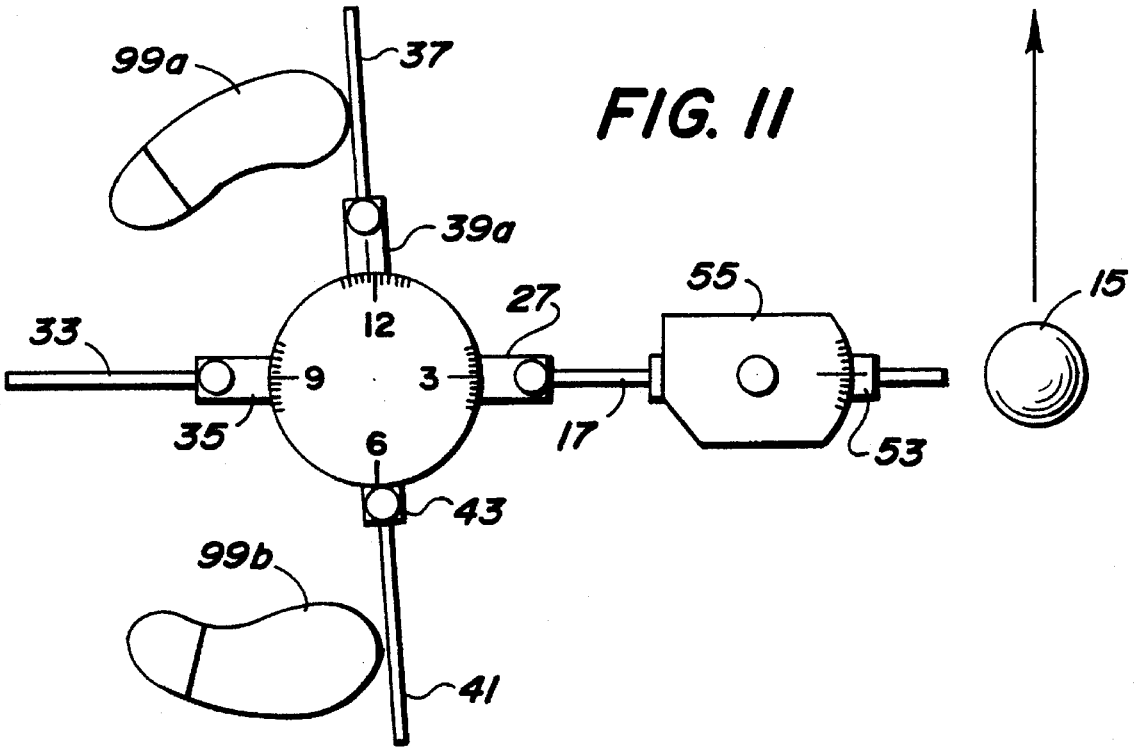

FIGS. 10 and 11 are further diagrammatic figures showing a further way of using the device of the invention in which closed alignment and open alignment of the stance is obtained by adjusting slightly the target pointer angle with respect to the ball pointer angle. In the instances shown, the ball pointer angle is maintained at 90 degrees with respect to the indices while the club face aligner angle is also maintained at 90 degrees with respect to the ball pointer. However, the target pointer as well as the target tail pointer has in FIG. 10 been slightly rotated to the right so that the target pointer is at a lesser angle than 90 degrees with respect to the ball pointer and the target tail pointer is at a greater angle than 90 degrees which is a reciprocal angle with respect to the ball pointer. This provides a so-called closed alignment and will result in the ball slicing or fading to the right.

In FIG. 11, on the other hand, the apparatus has been arranged in a so-called open alignment in which the target pointer has been indexed to an angle greater than 90 degrees with respect to the ball pointer and the target tail is therefore a reciprocal number of degrees less than 90 degrees with respect to the ball pointer. This provides a so-called open alignment and will produce a hook or a draw.

It will be recognized from a careful study of the appended drawings and the above description that a very unique aspect of the golf training and practice apparatus of the invention is the indexing system of the apparatus which allows the four pointers as well as the club face aligner to be synchronized and adjusted in distinct increments which allow a number of different positions and combinations of positions to be obtained. Thus variations in the ball position can be compensated for by indexing the club face alignment and the target pointer in order to produce a desired golf shot. There are many combinations which can be indexed for in order to obtain the desired placement of the ball in almost any spot. All such adjustments can be easily and quickly made by the golfer, particularly if the apparatus is securely pinned to the ground by the pointed tees 77 or equivalent ground anchoring devices, by quickly and easily adjusting the pointers and C.F.A. appropriate numbers of index divisions to arrive quickly either at a predetermined setting or at a setting which reproduces the golfer's stance and address to the ball at the last golf swing until a successful swing is obtained. The universal adjustment of the apparatus of the invention encourages the golfer to carefully monitor previous swings with apparatus so a substantially complete analysis can be recorded or maintained with respect to each swing until the desired results are obtained.

All the time, furthermore, the apparatus of the invention is providing a clear visual reference that can be seen by the golfer, felt kinesthestically by the golfer and physically measured by the golfer, thus providing the golfer with the means to both understand and learn in finite terms the geometric relationship that exists between himself, the club, the golf ball and the intended target. By using the apparatus in a manner intended, that is in a correct setup, the golfer can clearly see the relationship of his body to the intended line of flight of the ball. Such alignment relative to the target line is a key fundamental of obtaining a proper golf swing. It is well known that a perfect golf swing, made in the wrong direction, will produce an imperfect shot. Use of the apparatus of the invention enables the perfect swing to be made every time in a proper direction and therefore results in much more perfect shots. With a central hub providing a ready reference point and the target line pointer providing a straight reference line to the target, a golfer can more easily see and feel the relationship of the linear dimensions of the target line, and the circular dimension of the swing with respect to such line. Such relationship is critical to the concept of the swing plane and the swing path. In FIG. 12, for example, it can be seen how the circular swing of the golf club, which it will be understood extends at an angle with respect to the ground, is easily visualized by the use of the hub-type pointer of the invention when the apparatus is aligned correctly.

In FIG. 12, it can be seen that there are necessarily two intersecting lines which are tangent to each other, namely a linear line or the target line 97 extending towards the target and a circular line 101 which represents the club swing line intersecting the linear line 97 at a point of tangency. The golfer must visualize in his mind, in order to do a proper job of hitting a ball down the target line, the relationship between the linear target line and the circular swing line together with the angle of his club face, both vertically and to the side at the moment of impact with the ball at the intersection of the circular swing line and the linear target line. The apparatus of the invention, i.e. the central hub which is in itself somewhat analogous to the swing line and the four pointers, i.e. the target pointer, the target tail pointer which provide a reference for the feet of the golfer and the ball pointer which provides a reference for the position of the ball plus the foot pointer which provides an index point for the rear of the left foot all enable the golfer to visualize the proper relationships.

FIG. 13 is a diagrammatic depiction of a golfer partway through his swing indicated as a circular line 101 as in FIG. 12, but illustrating that such line or great arc 101 is not flat on the ground, but is an arc which extends at about a 45 degree angle from the golfer's shoulders to the ground and intersects the flight path of the ball which is illustrated by the target line 97 extending straight away from the original lay or address point 103 of the ball to the present instantaneous position of the ball 15 and is extended back to the end of the impact point 103 to show that the line was essentially straight. The swing of the golfer 105 therefore must, as explained above, intersect the straight target line of the ball at an angle in the air at the same time with the angle of the face of the club as exactly controlled. The device 11 of the invention materially aids the golfer in the visualization of proper relationships and therefore aids significantly in imparting good kinesthetic cues to the golfer's body as to exactly what he wishes to be doing in order to attain the visualized intersection of the arc of the swing and the straight line of the flight path or target line of a ball. Dotted lines 106 to the left of the parallel flight path and 108 to the right of the normal flight path show how the ball can be hit to either side by either a change in the stance to change the direction of the swing and attain either a pull to the left of the straight-ahead target line or a push to the right of the line or, by inclining the face of the club, obtaining either a slice or a fade to the left of the line or a hook or a draw to the right of the line.

Side spin is best created in the ball in order to cause hooks and slices as well as fades and draws, which are lesser degrees of hooks and slices, by a combination of club head angle at the moment of impact with the ball, and a somewhat deviated swing path at the moment of impact with the.ball. For example, an in-to-out swing path, i.e. drawing the club more towards one's left as it passes the impact point combined with a closed club head angle, i.e. inclined slightly to the left, produces a draw or, in some extreme cases, a hook. On the other hand, an out-to-in swing path with an open club face tends to produce a fade, or in more extreme cases, a slice, in which the ball first deviates to the left and then, due to its spin, deviates back towards the right.

It will be recognized that the apparatus of the invention very effectively both enables the golfer to monitor and visualize his swing pattern and also, by the use of the club face aligner, to determine the angle of the club. As a result, a very effective and reproducible shot pattern for golf can be attained.

It will also be understood that while the preferred embodiment of the combined apparatus of the invention has been shown and described above, other variations of such apparatus might be constructed. For example, FIG. 14 shows an alternative central indexing hub in which, instead of being circular and somewhat conical, or hemispherical, such indexing hub takes on essentially the shape of a cross with the indexing being positioned at the ends of the arms of the cross. It will be understood that the cross pattern may be extended through the entire hub, including the base, or that such cross pattern may only be with respect to the upper indexing central hub and not with the indexing hub base. In FIG. 14, the cross-shaped central indexing hub is designated by the reference numeral 107, while the base of the hub is indicated by the reference numeral 109. The base in this case takes a more or less slightly rounded-off rectangular shape. Separate indices for monitoring the displacement or rotation of the individual arms are designated by the reference numerals 111 at the cross pattern.

Figure 15:
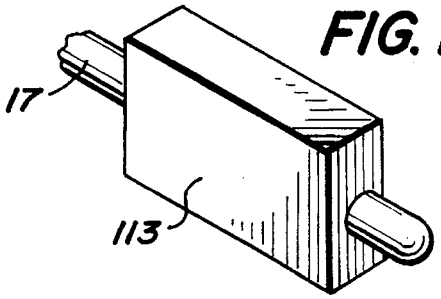
FIG. 15 is an isometric view of an alternative embodiment of a club face aligner rotatable about the ball pointer.

FIG. 15 shows an alternative form of club face aligner in which such aligner 113 is constructed as a rectangular body mounted upon a target pointer 17. The rectangular body 17 may be rotated in increments about the target pointer 17 in order to allow for the loft of the club. However, the angle of the face is determined by the angle at which the ball pointer is set, as explained as an alternative in previous diagrams.

Figure 16:
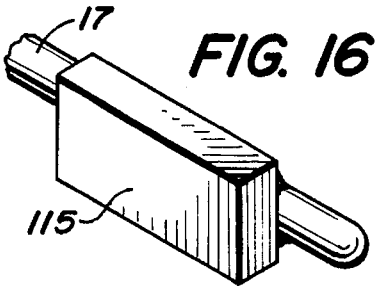
FIG. 16 is an isometric view of a simple alternative club face aligner attached directly to the ball pointer.

FIG. 16 is a further illustration of a simplified club face guide mounted on the side of the ball pointer, which guide is merely a flat plate 115 permanently attached to the side of the ball pointer 117 in a vertical direction. It will be understood that the club face aligner 115 shown in FIG. 16 will also, as in FIG. 15, be angled left or right by change of the angle of the ball pointer 17.

Figure 17:
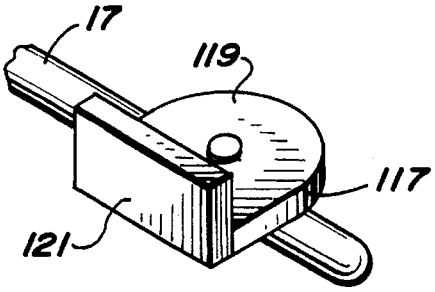
FIG. 17 is an isometric view of a still further alternative embodiment of a club face aligner pivotable upon the ball pointer.

FIG. 17 shows a still further alternative form of the club face aligner in which the aligner comprises a rotatable member 117 shroud which extends upwardly on either one or both sides of the ball pointer. The C.F.A. has a flat surface or face 121 which, as the club face guide or aligner is rotated on a pivot 119 passing through the ball pointer itself, causes the face 121 or faces to be turned either left or right, i.e. into either a closed or open position. The arrangement shown in FIG. 17 is not adjustable for loft of the club, but could be, with some further adjustments.

Figure 18:
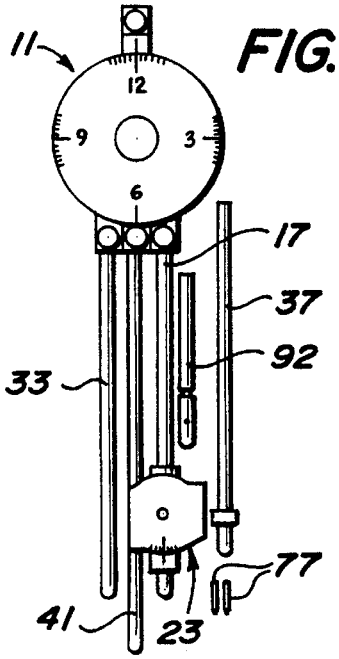
FIG. 18 is a plan view of the golf training and practice device of the invention in folded position for transportation or storage.

FIG. 18 is a plan view of the preferred form of the invention folded into storage or transporting position. It will be noted that the target pointer 37 has been removed and stored as a separate piece along with the short substitute ball pointer 92 available for shorter golf clubs and shorter golfers. This illustrates one arrangement for storage. However, a possibly even more frequent storage arrangement would be to remove the target tail pointer 41 while leaving the target pointer 37 attached to the central hub 36 and rotate both the foot pointer 33 and the ball pointer 17 all the way in the opposite direction. As noted above, the apparatus of the invention may be either stored in a golf bag or in a special bag or a case molded especially for it.

It is important to note that it is not imperative for a golfer's club to be square to anything. His personal manipulated swing may result in a combination of club face angles and body alignments that produce a desired, repetitive shot. While it would not be an "ideal", it may very well, as a practical matter, "work" perfectly well.

One of the most important elements of the club face aligner, and the way that it can align a club from really open to really closed, is that whatever club face angle ends up working for a golfer, it can be accurately measured, and therefore, repeated.

One of the most unique aspects of the main portion of the training aid of the invention is what may be termed the "indexing system". The indexing system may be defined as the way in which the four pointers, and the club face aligner, are synchronized and can be adjusted in distinct increments.

In other words, variations in, say, ball position can be compensated for by indexing the club face aligner to produce the desired shot.

Variations in the club face angle may be repeated by indexing the club face aligner left to close the club face at address, or right to open the club face at address.

What this means is that a golfer is now able to repeat accurately, measurably and consistently any combination of these setup components.

That is, no matter what type of shot is intended with whatever combination of ball position, body alignment, club face angle, and swing shape, those variables can be accurately fixed and measured, and therefore, repeatedly practiced.

Adjustments can be made with the ball pointer to position the ball in various locations and the club face aligner indexed square to the target line. Many combinations can be indexed for the desired placement of the ball. Whether adjusting back or forward, the indexing system provides a mechanical-visual reference for its user which is easily and conveniently used so that the golfer can make modifications in the adjustments as frequently as necessary or desired.

It will be seen from the above that the present invention serves very effectively, not only to aid visualization by the golfer of the relative interactions of the club and the ball and to monitor the angles of the club and the ball, but also, when combined with the club face aligner, enables a very effective positioning of the club face which is thereafter reproducible to obtain the best results possible.

It should be understood that although the present invention has been described at some length and in considerable detail and with some particularity with regard to several embodiments in connection with the accompanying figures and description, all such description and showing is to be considered as illustrative only and the invention is not intended to be narrowly interpreted in connection therewith or limited to any such particulars or embodiments, but should be interpreted broadly within the scope of the delineation of the invention set forth in the accompanying claims and thereby to effectively encompass the intended scope of the invention.

I claim:

1. A golf training and practice aid adapted to establish effective kinesthetic and visual references in a golfer comprising:

(a) a central housing means incorporating pivot mountings for a plurality of relevant alignment indicating pointers including:
(i) a target alignment pointer,
(ii) a ball alignment pointer, and
(iii) a foot alignment pointer, (b) said central housing means incorporating a plurality of indices against which to measure arcuate movement of each of the alignment pointers about their respective pivot mountings, (c) the indices being arranged and designed such that the arcuate movement of the three relevant alignment indicating pointers can be read with respect to movement of said pointers within the limits of separate quadrants of the central housing means for each of said pointers, (d) the central housing means being substantially round with the plurality of indices adjacent to the alignment pointers on one perimeter, and (e) wherein the target alignment pointer extends past the housing on two sides and is continued on one side of the housing in the form of an extended tail portion.

2. A golf training and practice aid in accordance with claim 1 wherein the extended tail portion of the target alignment pointer is constructed to simulate the end of a golf club.

3. A golf training and practice aid in accordance with claim 1 wherein the foot alignment pointer and ball alignment pointers are separately pivotable in opposite quadrants.

4. A golf training and practice aid in accordance with claim 1 wherein the plurality of indices are positioned along one edge of a substantially round shroud adjacent to the pointers.

5. A golf training and practice aid in accordance with claim 1 additionally including a slideable indicator incorporating a mechanical jam stop mounted on the tail portion of the target pointer.

6. A golf training and practice aid in accordance with claim 1 wherein at least one alternative length ball alignment pointer is provided for use with the training and practice aid when a golf ball is desired to be addressed at an alternative distance from the central housing.

7. A golf training and practice aid adapted to establish effective kinesthetic and visual references in a golfer comprising:

(a) a central housing means incorporating pivot mountings for a plurality of relevant alignment indicating pointers including:
(i) a target alignment pointer,
(ii) a ball alignment pointer, and
(iii) a foot alignment pointer, (b) said central housing means incorporating a plurality of indices against which to measure arcuate movement of each of the alignment pointers, (c) the indices being arranged and designed such that the arcuate movement of the three relevant alignment indicating pointers can be read with respect to movement of said pointers within the imits of separate quadrants of the central housing means for each of said pointers, (d) a substantially planar club alignment means having a club alignment surface said alignment means being secured adjacent to a side of the ball pointer adjacent to a terminal end of such ball pointer and arranged and constructed to be available to serve to align the face of a golf club head, (e) wherein the planar club alignment surface is arranged and constructed to be angularly adjustable transversely with respect to the longitudinal axis of the ball pointer to allow convenient alignment of a golf head face in both open and closed alignments, and (f) wherein the planar club alignment surface is arranged and constructed in addition to be circumferentially adjustable about the longitudinal axis of the ball pointer to accommodate loft of a club face.

8. A golf training and practice aid in accordance with claim 7 wherein the planar club alignment surface is associated with a mounting which can be removed from one ball pointer and attached to an alternative ball pointer of a different length.

9. An apparatus system for aiding a golfer to better visualize the relationship of swinging at a golf ball in a slanted arc to attain a desired flight of a golf ball along an intersecting line and to reproduce golf swings comprising:

(a) a central indexed hub having at least a substantial arcuate outline oriented toward a ball, (b) at least three pointers extending nominally at ninety degrees from the closest other pointer, (c) each pointer being independently pivotable at various degrees monitorable through separate indices, provided in separate quadrants of the central indexed hub, (d) each index having equal units positioned in corresponding separate quadrants of the indexed hub and being associated with an equal incremental positioning mechanism allowing each pointer to be moved in equal increments, (e) a club face aligner having a substantially planar face for alignment of the face of a golf club and secured to one of the pointers, said one of the pointers being adapted to serve as a ball lay indicating pointer, and (f) said planar face on said club face aligner being a surface upon a portion of a structure which is adjustable in equal angular increments transversely with respect to the longitudinal axis of the pointer upon which it is secured and in the same plane as the pointers and having equal substantially equivalent index units to those of the pointers, and (g) wherein the club face aligner is also rotatable about the longitudinal axis of the pointer to which it is secured.

* * * * *